US005657907A

United States Patent [19]

Dobbs et al.

[11] Patent Number: 5,657,907

[45] Date of Patent: Aug. 19, 1997

[54] ORIFICE COVER SLIDE FOR TRIGGER SPRAYER

[75] Inventors: Douglas B. Dobbs, Yorba Linad; Adonis Spathias, Duarte, both of Calif.

[73] Assignee: Calmar Inc., City of Industry, Calif.

[21] Appl. No.: 558,911

[22] Filed: Nov. 13, 1995

[51] Int. Cl.[6] ..... B67D 5/40

[52] U.S. Cl. ..... 222/153.14; 222/383.1; 222/559

[58] Field of Search ..... 222/153.01, 153.13, 222/153.14, 383.1, 559, 561; 239/333

[56] References Cited

U.S. PATENT DOCUMENTS

| | | | |
|---|---|---|---|
| 4,346,821 | 8/1982 | Wesner et al. | 222/153.14 X |
| 4,505,400 | 3/1985 | Bennett | 222/559 X |
| 4,606,480 | 8/1986 | Gazulla | 222/383.1 X |
| 4,637,531 | 1/1987 | Olsson | 222/559 |
| 4,679,712 | 7/1987 | Foster et al. | 222/153.13 X |

*Primary Examiner*—Andres Kashnikow
*Assistant Examiner*—Kenneth Bomberg
*Attorney, Agent, or Firm*—Watson, Cole Stevens Davis, P.L.L.C.

[57] ABSTRACT

A trigger pump sprayer has an external cover plate mounted on and parallel to an end wall of the pump body containing the discharge orifice for transverse sliding movement between an orifice covered position at which a first portion of the cover plate overlies the orifice and an orifice uncovered position at which a second portion of the cover having a through opening lies coaxial with the orifice. Guide tracks on said end wall supporting said plate for sliding movement are sloped toward the end wall for camming an inner surface of the first portion of the plate toward the confronting outer surface of the end wall for fluid tightly sealing the orifice closed against leakage in the covered position.

6 Claims, 1 Drawing Sheet

ORIFICE COVER SLIDE FOR TRIGGER SPRAYER

BACKGROUND OF THE INVENTION

This invention relates generally to a cover for sealing the orifice of a trigger pump sprayer closed against leakage, and more particularly to such a cover mounted for transverse sliding movement between orifice covered and uncovered positions.

Nozzle orifice covers for trigger sprayers have been developed for sealing the orifice closed in a cover closed position, the cover generally being hinged to the pump body for swinging movement between open and closed positions. An example of such a cover or door for a trigger pump sprayer is disclosed in U.S. Pat. No. 4,606,480.

U.S. Pat. No. 4,679,712 discloses a cover slide member for a high viscous pump dispenser, the member not only covering and sealing off the discharge orifice of a fixed spout, but also overlying the same in such a manner that the actuating button is locked against accidental operating depression. The leading edge of the slide is beveled to present a sharp edge for cleanly severing the dispensed ribbon of viscous product from the spout. Alternatively, the cover slide member is mounted for covering and sealing off the orifice formed in a reciprocating spout.

U.S. Pat. No. 4,346,821 discloses a cover slide for a liquid dispenser shiftable between orifice covered and uncovered positions, the cover slide having a first deflective portion with a detent for locking the cover slide in both discharge orifice covered and uncovered positions. The detent is released upon a manual pull of the first deflective portion in a direction toward a trigger actuator provided for the dispenser. The cover slide has a second deflective portion providing a biasing effect forcing the second deflective portion against a boss surrounding the discharge orifice for sealing the orifice closed when the cover slide is shifted to the orifice closed position.

SUMMARY OF THE INVENTION

It is an object of the present invention to provide a sliding cover for sealing the discharge orifice of a trigger pump sprayer closed against leakage as an improvement over the prior art covers which require complex and costly molding and assembly operations for sealing the orifice of a pump sprayer closed against leakage. More particularly, the cover or slide plate of the invention is mounted on and parallel to an end wall of the pump housing containing the discharge orifice, the plate being slidable in a transverse direction relative to the spray discharge direction between an orifice covered position at which a portion of the plate overlies the orifice, and an orifice uncovered position at which a through opening of the plate lies coaxial with the orifice. Guide tracks on the end wall supporting the cover plate are inwardly sloped to cam an inner surface of the cover plate fluid tightly against the confronting surface of the end wall for sealing the orifice in the closed position of the cover plate. The provision of any such second deflective portion of the prior art is thus avoided.

Limit stops acting between the pump body and the cover plate may be provided for limiting the cover in its closed and open positions, and the cover plate may be rendered child resistant.

The child resistant feature includes a spring biased lock in the form of an integral spring clip on the cover in engagement with the end wall containing the orifice in the covered position, such as a detent projecting into a recess formed in the end wall. The spring clip must be sprung outwardly by one hand to disengage the detent while the cover plate is shifted by the other hand, thereby providing a simple and economical yet highly effective child resistant feature.

DETAILED DESCRIPTION OF THE INVENTION

Figure 1:
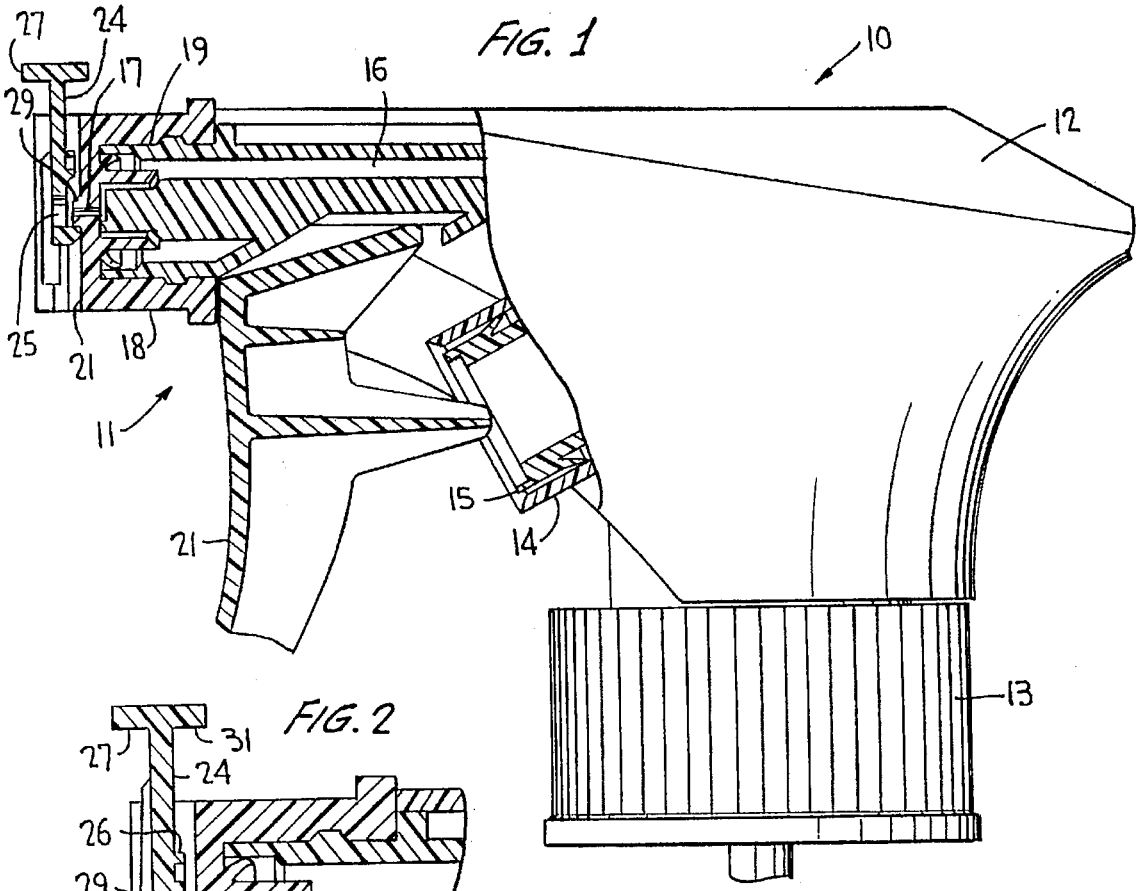
FIG. 1 is a side elevational view, partly in section, of a trigger pump sprayer incorporating the invention.

Turning now to the drawings wherein like reference characters refer to like and corresponding parts throughout the several views, a trigger pump sprayer generally designated 10 is shown in FIG. 1, the sprayer being of known construction for mounting on a container (not shown) of product to be dispensed. The sprayer comprises a pump body 11 covered by a shroud 12, the body having a thread closure 13 for mounting the sprayer onto the container.

The pump body includes a pump cylinder 14 containing a reciprocable pump piston 15 defining with the cylinder a variable volume pump chamber. A longitudinal discharge passage 16 extends from the pump chamber and terminates in a discharge orifice 17 located in a nozzle cap 18 fixed at nozzle end 19. A trigger lever 21 is hingedly connected to the pump body for actuating the piston upon each pull of the trigger.

Figure 4:
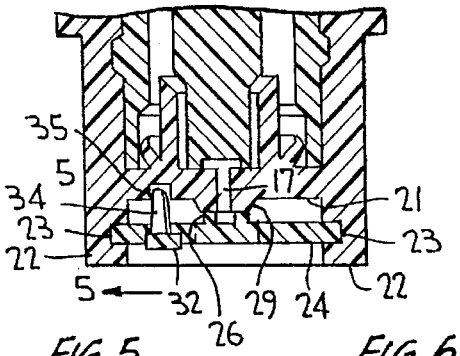
FIG. 4 is a sectional view taken substantially along the line 4—4 of FIG. 3.

The nozzle cap, which essentially forms part of the pump body, has an end wall 21 containing the discharge orifice, a pair of arms 22 formed integrally with the nozzle cap being located downstream of end wall 21 and having a pair of opposing guide tracks 23 (FIG. 4). The guide tracks extend in a direction transverse to the longitudinal direction of the discharge passage and orifice in either the position shown in the drawings or in a position 90° thereto but still transverse to the longitudinal direction.

A cover plate 24 has its opposing side edges engaging the guide tracks for sliding movement therealong. The cover plate has an enlarged through opening 25 in axial alignment with discharge orifice 17 in the orifice uncovered position of FIGS. 1 and 2. In the orifice covered position of FIGS. 3, 4 and 6, a portion of the cover plate overlies the discharge orifice and seals the orifice closed by the provision of an embossment 26 formed on the inner face of the cover plate. The plate is manually movable between its orifice covered and orifice uncovered positions as by the provision of a finger engaging flange 27 which may extend transversely of the cover.

Limit stops acting between the cover plate and the nozzle cap may be provided for limiting the cover in its orifice covered and uncovered positions. For example, the cover may be provided with a detent 28 extending from its inner face in engagement in the FIGS. 1 and 2 positions with the underside of an embossment 29 surrounding the discharge orifice. And, a transversely extending flange 31 extending from the inner face of the cover plate may be provided for engaging the confronting side wall of the nozzle cap in the orifice cover closed position of FIGS. 3 and 6.

To enhance the sealing engagement between embossments 26 and 29, tracks 23 are sloped inwardly from top to bottom to present a camming action for the cover plate.

Figure 5:
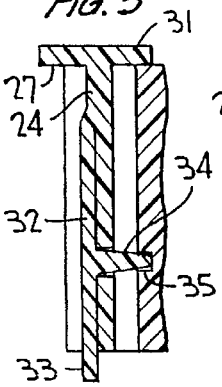
FIG. 5 is a sectional view, taken substantially along the line 5—5 of FIG. 4.
Figure 6:
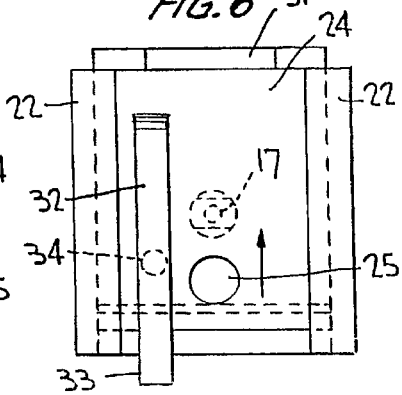
FIG. 6 is a front elevational view taken substantially along the line 6—6 of FIG. 3.

In accordance with another feature of the invention, the cover plate may be locked in its covered position by the provision of a spring leg 32 formed integrally with the cover plate as best seen in FIGS. 5 and 6, the free end 33 extending beyond the lower edge of the cover plate. The spring leg has a projection 34 engaging a recess 35 for locking the plate in the orifice covered position of FIG. 3.

Figure 2:
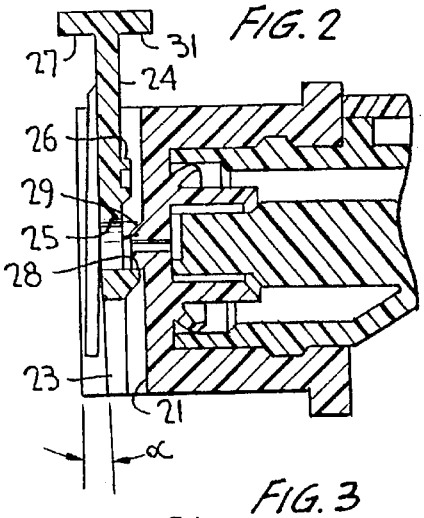
FIG. 2 is a vertical sectional view at the nozzle end of the trigger sprayer, at an enlarged scale, showing the cover slide in its orifice uncovered position.
Figure 3:
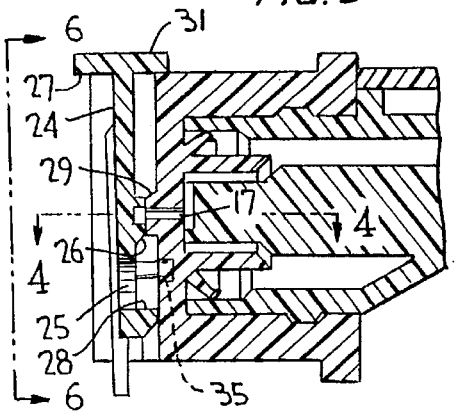
FIG. 3 is a view similar to FIG. 2 showing the cover slide in its orifice covered position.

For uncovering the orifice, free end 33 of the spring leg is simply shifted in the forward direction by one hand for disengaging projection 34 from recess 35 while the operator with the other hand pushes upwardly against flange 27 for shifting the cover plate from its locked and orifice covered and sealed position of FIG. 3 to the orifice uncovered position of FIG. 2. The cover plate is thus rendered child-resistant.

FIGS. 5 and 6 illustrate the spring leg as overlying the cover plate, although the spring leg may likewise be formed integrally to lie in the same plane as the cover plate, within the scope of the invention.

Obviously, many other modifications and variations of the present invention are made possible in the light of the above teachings. It is therefore to be understood that within the scope of the appended claims the invention may be practiced otherwise than as specifically described.

What is claimed is:

1. In a trigger pump sprayer comprising a housing including a pump cylinder containing a reciprocable pump piston defining with said cylinder a variable volume pump chamber, a longitudinal discharge passage in said housing extending from said chamber and terminating in a discharge orifice located in an end wall of said housing, an external cover plate mounted on and parallel to said end wall for transverse sliding movement between an orifice covered position, at which a first portion of said cover plate covers said orifice, and an orifice uncovered position at which a second portion of said cover having a through opening lies coaxial with said orifice, an inner surface of said first portion bearing against a confronting outer surface of said end wall at said orifice in said covered position for fluid tightly sealing said orifice against leakage therethrough, the improvement wherein said end wall has a pair of opposing guide tracks receiving opposed edges of said cover plate for guiding said plate between said positions, said tracks sloping inwardly between opposing ends thereof toward said end wall for camming said inner surface of said first portion toward said confronting outer surface of said end wall in said covered position.

2. In the pump sprayer according to claim 1, wherein said outer surface of said end wall has an embossment surrounding said orifice, said inner surface of said second portion fluid tightly engaging said embossment in said covered position.

3. In the pump sprayer according to claim 2, wherein said cover plate has means engaging an outer edge of said embossment in said uncovered position for limiting the sliding movement of said cover plate in one direction.

4. In the pump sprayer according to claim 3, wherein said cover plate has a projection engaging said housing in said covered position for limiting the sliding movement of said cover plate in a direction opposite said one direction.

5. In the pump sprayer according to claim 1, wherein said cover plate includes an integral spring clip having a detent projecting in said closed position into a recess formed in said end wall for locking said cover plate in said covered position, said spring clip extending transversely beyond said end wall to form a finger latch for manually disengaging said detent from said recess upon application of finger force to said latch in a direction away from said outer surface of said end wall.

6. In the pump sprayer according to claim 1, wherein said cover plate has finger engaging means to facilitate manual sliding movement of said cover plate between said positions.

* * * * *